US009482047B2

(12) United States Patent
Anti et al.

(10) Patent No.: US 9,482,047 B2
(45) Date of Patent: Nov. 1, 2016

(54) SEALED SLATTED BLIND

(71) Applicant: Newell Window Furnishings, Inc., High Point, NC (US)

(72) Inventors: Victor Anti, Centreville, VA (US); Peter Bates, Framingham, MA (US); Michael Defenbaugh, Dunwoody, GA (US); Joshua Maust, Roswell, GA (US); Teresa Williamson, Marietta, GA (US); Alexandra Unger, West Newbury, MA (US)

(73) Assignee: Newell Window Furnishings, Inc., High Point, NC (US)

( * ) Notice: Subject to any disclaimer, the term of this patent is extended or adjusted under 35 U.S.C. 154(b) by 0 days.

(21) Appl. No.: 14/467,607

(22) Filed: Aug. 25, 2014

(65) Prior Publication Data

US 2014/0360683 A1 Dec. 11, 2014

Related U.S. Application Data

(62) Division of application No. 13/458,099, filed on Apr. 27, 2012, now Pat. No. 8,844,603.

(60) Provisional application No. 61/480,132, filed on Apr. 28, 2011.

(51) Int. Cl.

| | |
|---|---|
| ***E06B 9/303*** | (2006.01) |
| ***E06B 9/32*** | (2006.01) |
| ***E06B 9/307*** | (2006.01) |
| ***E06B 9/386*** | (2006.01) |

(52) U.S. Cl.

CPC ..... *E06B 9/32* (2013.01); *E06B 9/303* (2013.01); *E06B 9/307* (2013.01); *E06B 9/386* (2013.01)

(58) Field of Classification Search

CPC ..... E06B 9/26; E06B 9/30; E06B 9/32; E06B 9/386

See application file for complete search history.

(56) References Cited

U.S. PATENT DOCUMENTS

| | | | | |
|---|---|---|---|---|
| 723,762 | A | 3/1903 | Tumler | |
| 2,061,548 | A | 11/1936 | Cameron | |
| 2,111,979 | A | 3/1938 | Lawson et al. | |
| 2,121,217 | A | 6/1938 | Ellis | |
| 2,218,508 | A | 10/1940 | Gentile | |
| 2,292,001 | A * | 8/1942 | Wright | 160/40 |
| 2,405,255 | A | 8/1946 | Horton | |
| 2,618,330 | A | 11/1952 | Janowski | |
| 2,620,865 | A | 12/1952 | Isserstedt | |
| 2,723,716 | A * | 11/1955 | Berni | 160/168.1 R |
| 2,728,108 | A | 12/1955 | Schlegel, Jr | |

(Continued)

OTHER PUBLICATIONS

Window covering sold by Vista Products, Inc.

*Primary Examiner* — Katherine Mitchell
*Assistant Examiner* — Scott Denion
(74) *Attorney, Agent, or Firm* — Sutherland Asbill & Brennan LLP

(57) ABSTRACT

A window covering comprises slats suspended from a tilt cord such that the tilt cord may rotate the slats between an open position and a closed position. An elastic seal is provided on the slats to contact adjacent slats when the slats are in the closed position. A mechanism such as a spring or a magnet applies a closing force to the slats in the closed position separate from the tilt cord where the closing force moves the slats toward one another. An elastic seal is provided on the slats to contact adjacent slats when the slats are in the closed position.

10 Claims, 10 Drawing Sheets

(56) References Cited

U.S. PATENT DOCUMENTS

| | | | | | |
|---|---|---|---|---|---|
| 2,749,976 | A | | 6/1956 | Lewis | |
| 2,804,924 | A | | 9/1957 | Dennen | |
| 3,156,295 | A | | 11/1964 | Vecchiarelli et al. | |
| 3,332,471 | A | | 7/1967 | Croxen | |
| 4,292,763 | A | * | 10/1981 | Barnes et al. | 49/64 |
| 5,558,146 | A | * | 9/1996 | Abe | 160/176.1 R |
| 5,597,027 | A | | 1/1997 | Simon et al. | |
| 5,769,140 | A | | 6/1998 | Tuzmen | |
| 5,957,183 | A | | 9/1999 | Prince | |
| 6,167,938 | B1 | | 1/2001 | Chien | |
| 6,263,944 | B1 | | 7/2001 | Judkins | |
| 6,959,750 | B2 | * | 11/2005 | Colson | 160/176.1 R |
| 2004/0065418 | A1 | | 4/2004 | Colson | |
| 2005/0230063 | A1 | | 10/2005 | Hwang | |
| 2009/0321024 | A1 | | 12/2009 | Harper et al. | |
| 2012/0234506 | A1 | | 9/2012 | Defenbaugh et al. | |

* cited by examiner

SEALED SLATTED BLIND

This application is a divisional of U.S. patent application Ser. No. 13/458,099, filed Apr. 27, 2012, which, in turns, claims the benefit of U.S. Provisional Patent Application Serial No. 61/480,132 filed Apr. 28, 2011, the entire contents of which are hereby expressly incorporated by reference.

BACKGROUND

Window coverings provide aesthetics, privacy and light control. One type of window covering is a slatted blind that comprises a plurality of slats suspended from a head rail. The slats may be articulated between open positions where the slats are spaced from one another and closed positions where the slats are rotated toward one another to create a privacy panel.

SUMMARY OF THE INVENTION

According to one embodiment a window covering comprises a first slat and a second slat suspended from a tilt cord such that the tilt cord may rotate the first slat and a second slat between an open position and a closed position. An elastic seal on the first slat is positioned to contact the second slat when the first slat and the second slat are in the closed position.

The seal may be made of an elastomeric polymer. The first slat may be extruded of a rigid plastic and the seal may be co-extruded of a relatively more elastic material. The seal may be formed along a longitudinal edge of the first slat. The seal may extend from the first slat in a cantilevered fashion such that one longitudinal edge of the first slat is formed by the seal. The seal may extend beyond the plane of the first slat. A first magnetic field of a first polarity may be formed along a first longitudinal edge of the first slat and a second magnetic field of a second polarity may be formed along a second longitudinal edge of the second slat where in the closed position the first longitudinal edge may be disposed adjacent the second longitudinal edge. A second elastic seal may be provided on the second slat positioned to contact the seal when the first slat and the second slat are in the closed position. A thermally insulating film may be applied over at least a portion of a surface of the first slat and at least a portion of a surface of the second slat.

According to another embodiment a window covering comprises a first slat and a second slat suspended from a tilt cord such that the tilt cord may rotate the first slat and the second slat between an open position and a closed position. A magnetic field applies a closing force to at least one of the first slat and the second slat in the closed position separate from the tilt cord where the closing force moves the first slat and the second slat toward one another.

A first magnetic field of a first polarity may be formed along a first longitudinal edge of the first slat and a second magnetic field of a second polarity may be formed along a second longitudinal edge of the second slat where, in the closed position, the first longitudinal edge is disposed adjacent the second longitudinal edge. A first magnetic field of a first polarity may be formed along a first longitudinal edge of the first slat and a ferromagnetic material may be formed along a second longitudinal edge of the second slat where in the closed position the first longitudinal edge is disposed adjacent to the second longitudinal edge. The magnetic field may be created by a magnet having a first polarity that may be supported along a first longitudinal edge of the first slat and a second magnet having a second polarity that may be supported along a second longitudinal edge of the second slat where in the closed position the magnet is disposed adjacent the second magnet. The magnet may be extruded in the slat. The magnet may be a tape magnet. A first magnetic field of a first polarity and a second magnetic field of a second plurality may be formed along a first longitudinal edge of the first slat and a third magnetic field of the first polarity and a fourth magnetic field of the second polarity may be formed along a second longitudinal edge of the first slat and a fifth magnetic field of the first polarity and a sixth magnetic field of the second plurality may be formed along a first longitudinal edge of the second slat and a seventh magnetic field of the first polarity and an eighth magnetic field of the second polarity may be formed along a second longitudinal edge of the second slat. The first magnetic field and the third magnetic field may be formed on a first surface of the first slat and the second magnetic field and the fourth magnetic field may be formed on a second surface of the first slat and the fifth magnetic field and the seventh magnetic field may be formed on a first surface of the second slat and the sixth magnetic field and the eighth magnetic field may be formed on a second surface of the second slat. The magnet may extend beyond a first longitudinal edge of the first slat to create a pocket for receiving a second longitudinal edge of the second slat. The first slat and the second slat may be connected to vertical lift cords by a rotating clip such that the positions of the first slat and the second slat are fixed relative to the vertical lift cords.

According to another embodiment a window covering comprises a first slat and a second slat suspended from a tilt cord such that the tilt cord may rotate the first slat and the second slat between an open position and a closed position. A spring is disposed between the tilt cord and the first slat for applying a closing force to the first slat in the closed position where the closing force biases the first slat toward the second slat.

DETAILED DESCRIPTIONS OF EMBODIMENTS OF THE INVENTION

In a typical existing slatted blind, gaps may occur between adjacent slats even when the slats are moved to the fully closed position. These gaps may be especially pronounced at the bottom and top of the blind panel; however, gaps may be present throughout the height of the blind. Because of the gaps between the slats, slatted window coverings, even when closed, do not create an impermeable thermal insulating barrier. Because of the difficulty in making a thermal insulating barrier with a slatted blind, cellular shades are traditionally the window treatment of choice where an insulating window covering is desired. A slatted blind that is able to close fully such that it provides thermal insulation functionality is disclosed herein. The blind of the present invention seals the slats against one another in a manner that meets the fashion needs of the consumer and is energy efficient and can lower energy usage and costs. In addition to increasing the thermal insulation property of the blind, the elimination of the gaps between adjacent slats also increases the light blocking capability of the shade.

Figure 1:
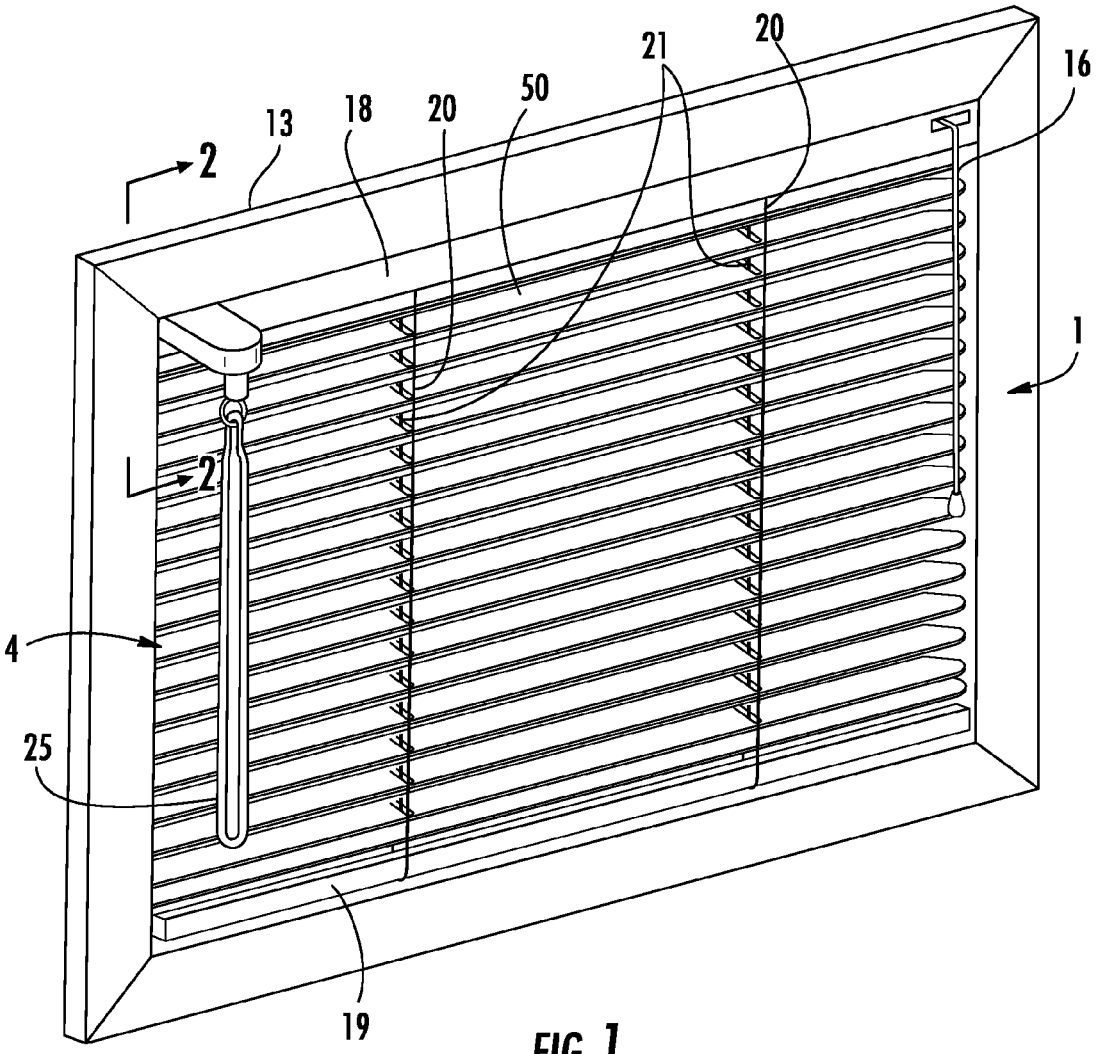
FIG. 1 is a perspective view of a slatted blind.
Figure 2:
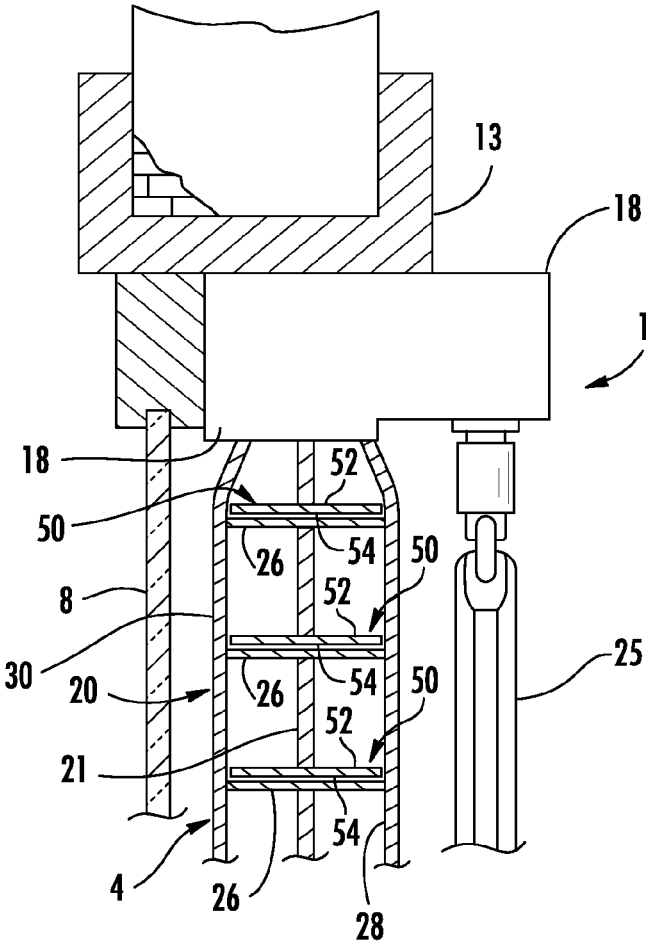
FIG. 2 is a partial section view of the blind of FIG. 1

Referring to FIGS. 1 and 2 an embodiment of a window covering 1 is shown comprising a head rail 18 from which a slatted blind 4 is suspended. The slatted blind comprises a plurality of slats 50. The head rail 18 may be constructed of wood, steel or other rigid material and may be solid or have an interior channel. It is appreciated that, in some embodiments, the term "head rail" need not be limited to a traditional head rail structure and may include any structure, component or components from which a shade may be suspended or supported and which may include operating systems and/or shade control components. The head rail 18 may be mounted to a window frame 13 or other architectural feature by brackets or other mounting mechanisms to cover the window or other opening 8. The slatted blind 4 has a top edge that is located adjacent to the head rail 18 and a bottom edge remote from the head rail 2 that may terminate in a bottom rail 19.

The slats 50 may be supported by lift cords 21 that are connected to the bottom of the shade 4 or to the bottom rail 19 where the lift cords 21 may be retracted toward the head rail 18 to raise the shade or extended away from the head rail to lower the shade. The lift cords 21 may be operatively connected to a pull cord 16 or other user control that may be manipulated by the user to raise and lower the slats.

The slats 50 are also supported by a tilt cord 20 that functions to tilt the slats 50 between an open position where the slats 50 are spaced from one another and closed positions where the slats 50 are disposed in an abutting, overlapping manner to create a sealed insulating panel. The tilt cord 20 may comprise a ladder cord as shown that supports the individual slats 50 where manipulation of the ladder cord results in the tilting of the slats between the open position, the closed positions and any intermediate position. The tilt cord 20 may be controlled by a user control 25 such as a control wand or cord that is manipulated by the user to adjust the opening and closing of the slats. Typically, the slats will be supported by two or more tilt cords 20 and two or more lift cords 21 depending upon the width of the window covering. A variety of cord control mechanisms may be provided to control and manage the lift cords and tilt cords including cord locks, control drums, brakes and the like. While a specific embodiment of a window covering is disclosed, the window covering may have a wide variety of constructions. For example, the pull cord may be replaced by a spring motor or an electric motor to control the raising and lowering of the slats. The tilt cord may be replaced by ribbons or other flexible member for tilting the slats and the control of the tilting of the slats may be accomplished using an electric motor or other control. Further, the slats 50 may have a variety of configurations and finishes and may be made of any suitable material including, but not limited to, wood, metal, plastic, composites or the like.

Figure 4:
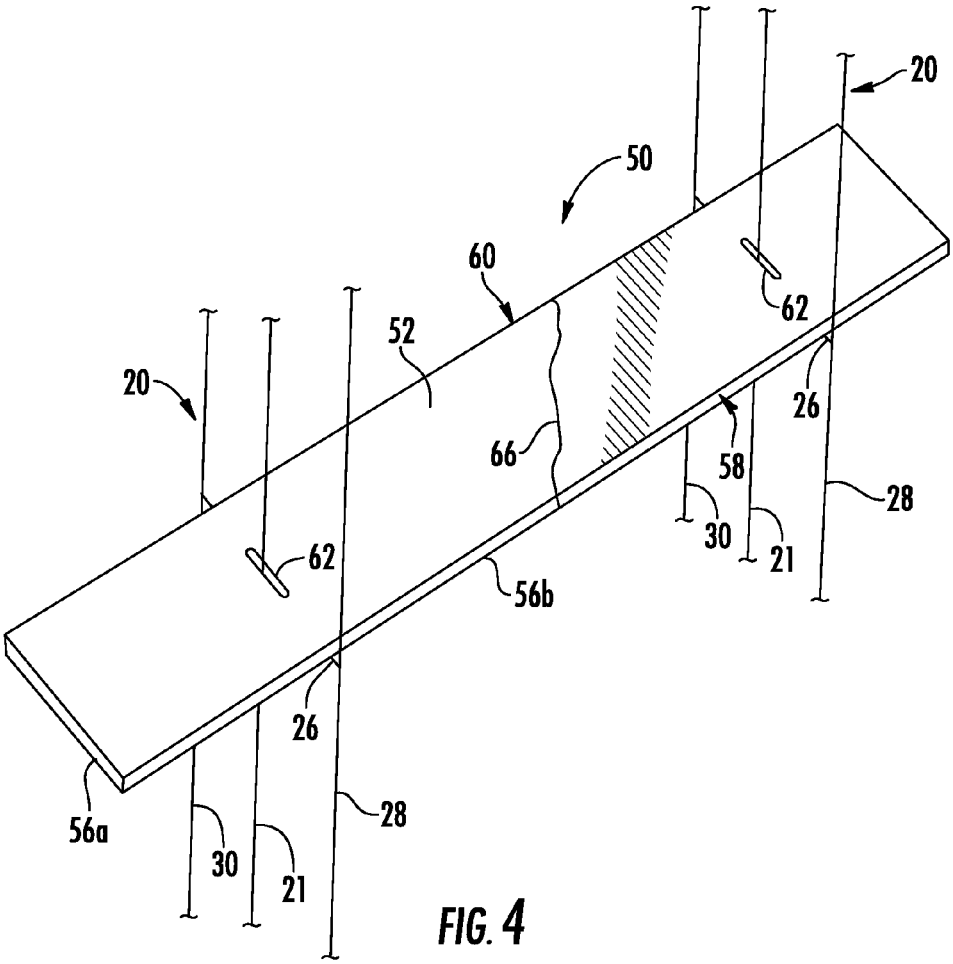
FIG. 4 is a perspective schematic view of a slat and cords showing a first embodiment of the invention.

Referring to FIGS. 2 and 4, each tilt cord 20 may comprise a ladder cord that has a plurality of rungs 26 that are connected to and supported at each end by vertical support cords 28 and 30. A slat 50 rests on top of and is supported by each rung 26. A drum or other control device may be rotated by a user using a control 25 such that the front vertical support cord 28 may be raised or lowered while the back vertical support cord 30 is simultaneously lowered or raised, respectively, to tilt the rungs 26 between fully closed positions, a fully open position or any intermediate position. In the fully open position the rungs 26 and slats 50 are disposed substantially perpendicular to the vertical support cords 28 and 30 to minimize the obstruction caused by the slats as shown in FIG. 2. In either of the fully closed positions the slats are arranged near vertically where adjacent slats are in an overlapping relationship. A typical slatted blind has two fully closed positions because the slats may be rotated approximately 180 degrees such that either longitudinal edge of the slats may be in the top position when the blinds are fully closed.

Referring to FIG. 4 an embodiment of a slat 50 and associated tilt cords 20 and lift cods 21 are illustrated. The slat 50 may be made of a variety of materials including but not limited to wood, aluminum, plastic, polymers or the like and may have a variety of colors, shapes, sizes, finishes and the like. Further, the slats, while generally planar, may have a shape other than strictly planar. For example, some slats are formed with a curve or bend. The slats may also have a variety of surface textures. Each slat 50 has a first surface 52 and an opposed second surface 54. For explanation purposes surface 52 is referred to as a top surface and surface 54 is referred to as a bottom surface; however, in use the orientation of the slat changes such that the spatial orientation of the surfaces also changes. For example, in use of a typical slatted blind the slats are able to rotate approximately 180 degrees between closed positions such that the relative spatial orientation of the surfaces 52 and 54 will change. The top surface 52 and bottom surface 54 are connected to one another by narrow side surfaces 56*a*, 56*b*, 56*c* and 56*d* to form a relatively thin slat 50. The interior of the slat 50 may be solid, hollow or may comprise a plurality of different materials. The slat 50 comprises a first longitudinal edge 58 and a second longitudinal edge 60 where the longitudinal edges 58 and 60 are the areas adjacent to and defining the long edges of the slat comprising surfaces 56*b* and 56*d* and the portions of surfaces 52 and 54 adjacent to surfaces 56*b* and 56*d*, respectively. For explanation purposes edge 58 is referred to as a front longitudinal edge and edge 60 is referred to as a rear longitudinal edge; however, in use the orientation of the slat changes such that the spatial orientation of the longitudinal edges also varies. According to one embodiment, as shown in FIG. 4, the slat may also comprise apertures or slots 62 for receiving the lift cords 21. However, in other embodiments, the slats may not include any apertures or slots therein, but be constructed such that the lift cords pass on the first or second longitudinal edges 58, 60 which serves to eliminate the apertures through the slats.

Figure 3:
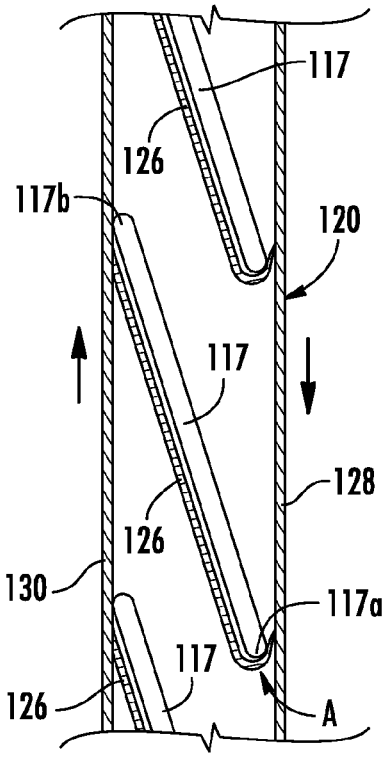
FIG. 3 PRIOR ART
FIG. 3 is a side view illustrating the operation of a slatted blind.

When a typical slatted blind is fully closed, the slats are preferably at an angle of approximately 4 to 5 degrees relative to vertical. However, in some existing blinds the slats "slouch" as shown in FIG. 3. The slats that slouch at a greater angle relative to vertical do not seal shut completely because the slats, even when the tilt cord is in the fully closed position, are spaced from one another and do not assume the desired abutting and overlapping relationship. The slats that are disposed at an angle of 4 to 5 degrees relative to vertical may be in an overlapping and abutting relationship relative to one another; however, even these slats may not seal along their entire width because of, for example, irregularities in the planarity of the slats.

The inventors of the present application have determined that the largest increase in thermal insulating performance may be obtained by applying a film 66, such as a lowE film, on the slats as shown in FIG. 4. In use film 66 is applied over the entire area of surface 52 or surface 54 and may be applied over both of surfaces 52 and 54. The film may also cover the narrow side surfaces 56*a* to 56*d*. While such a film provides desirable insulation characteristics, the visual aesthetics of a blind covered in a film may not be acceptable to all consumers. The use of a thermally insulating film, such as a lowE film, on the slats, may be used in combination with any of the embodiments described herein.

Another blind characteristic that provides desirable thermal insulating characteristics is a sealed slat arrangement. The sealed slat arrangement may also be used in combination with the insulating film or with a slat having an internal geometry that increases the thermal insulating properties of the slat. In tests performed by the inventors a standard slatted blind closure having gaps between the slats and a sealed slatted blind closure were tested and compared in an energy chamber designed to measure the U-value for window treatments. The test method used parallel NFRC 100A for measuring U-value of attachment products; however, the base case window was a dual pane, clear glass non-metal framed product with a U-value of 0.48. The tests showed a 20% improvement in U-value between a standard slatted blind closure and a sealed slatted blind closure as described herein.

It has been found that in a typical ladder construction for slatted blinds the adjacent edges of the slat do not completely seal against one another without the application of a secondary normal force on the slats. When a standard slatted blind is in the closed position the slats assume an orientation near vertical. The sealing force is applied approximately normal to the bottom surface 54 of the slat which is approximately horizontal when the slat is nearly closed. While the force is referred to as a "normal", the force need not be perfectly normal to the slat provided the force moves the slats against one another to create a fully closed, sealed blind.

Figure 5:
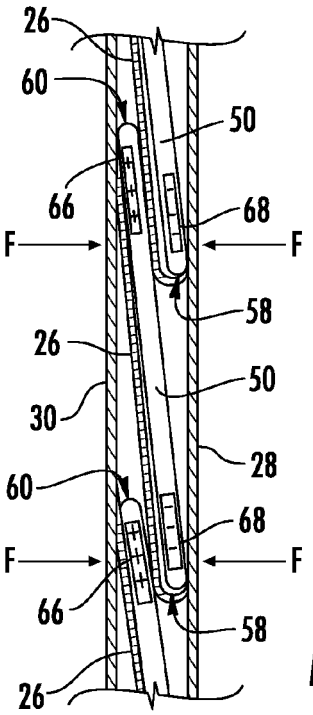
FIG. 5 is a side view showing another embodiment of the invention.

One mechanism for providing the normal sealing force is to provide an embedded magnetic field on the edge of each slat. In the embodiment of FIG. 5 a slatted blind is shown where a magnetic field of opposite polarity is formed along each longitudinal edge 58 and 60 of the slats 50. For example, one longitudinal edge 60 of each slat 50 is provided with a positive polarity magnetic field 66 and the other longitudinal edge 58 of each slat 50 is provided with a negative polarity magnetic field 68. Each slat 50 in the blind panel has the same longitudinal edge provided with the same polarity magnetic field such that when the slats are tilted to the closed position, shown in FIG. 5, the opposing polarity magnetic fields 66 and 68 are disposed adjacent to one another and attract one another to apply closing forces F on the slats 50 that pulls the front longitudinal edge 58 of one slat into engagement with the rear longitudinal edge 60 of the adjacent slat. In the sealed position of FIG. 5, the longitudinal edges of one slat are in abutting contact with, or very closely spaced from, the longitudinal edges of the adjacent slats along the entire length of the slats. The sealing force F generated by the magnetic fields is selected to provided enough force to seal the slats against one another while minimizing the opening force required to separate the slats during opening of the window covering.

Figure 6:
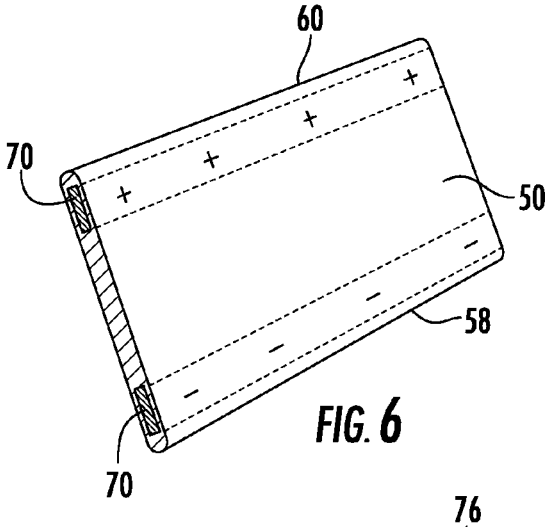
FIG. 6 is a perspective section view of a first embodiment of a slat used in the blind of FIG. 6.

The magnetic fields may be created by magnets positioned in the slats 50 such that the magnets are not visible during normal use of the window covering. In one embodiment a polymer slat 50 may comprise strip or tape magnets 70 that are co-extruded or cross-head die extruded into the polymer material that forms the slats 50 as shown in FIG. 6. In such an embodiment the magnets may be completely embedded in the polymer material of the slat during the making of the slat. The location of the magnets 70 in the polymer material of the slat may be varied by varying the extrusion die or process. The ferric material of the magnets 70 may be magnetized before or after the ferric material is embedded in the polymer material. Because the Curie temperature of a tape magnet is lower than the extrusion temperature of the polymer slat, the ferritic material may be demagnetized during the extrusion process. In such a situation the ferritic material may be extruded in a demagnetized state and then magnetized after formation of the slat.

Figure 7:
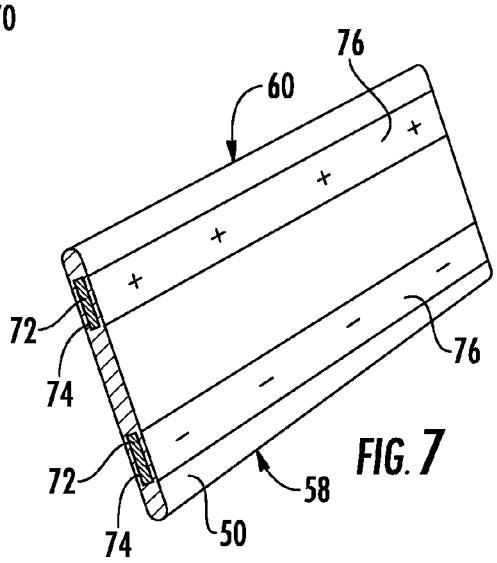
FIG. 7 is a perspective section view of a second embodiment of a slat used in the blind of FIG. 5.

The magnet may also be applied to a pre-formed slat such as by using adhesive or a mechanical connector. In such an embodiment the magnet may be visible during use of the window covering if attached to an outside surface of the slat. To improve the slat's appearance, the strip or tape magnets 72 may be located in slots 74 that are routed into or otherwise formed in the slat 50 to maintain the outward appearance of the slat, as shown in FIG. 7. The magnets 72 and slots 74 may be covered by caps 76 to further conceal the magnet where the caps fit into the slots 74 and match the external appearance of the slat 50.

Figure 8:
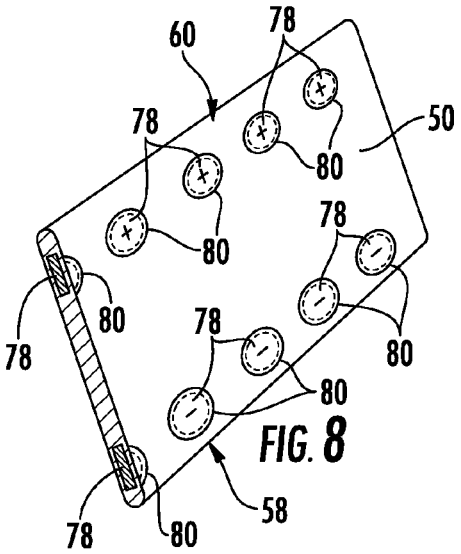
FIG. 8 is a perspective section view of a third embodiment of a slat used in the blind of FIG. 5.

The magnets, rather than being strip or tape magnets, may comprise a plurality of separate magnets 78 spaced along the longitudinal edges 58 and 60 of the slat 50 as shown in FIG. 8. The magnets may be retained in holes or grooves formed in the slats such that the slat planarity is maintained. The magnets 78 may be covered by caps 80 to further conceal the magnets. Where a plurality of individual magnets are used, the magnets on the front longitudinal edge 58 should be positioned opposite the magnets on the rear longitudinal edge 60 such that the magnets on adjacent slats are disposed opposite to one another when the blind is closed.

In another embodiment, the magnet on either the front longitudinal edge 58 or rear longitudinal edge 60 of the slat 50 may be replaced by a non-magnetized material that is attracted to the magnet on the other of the front or rear edge such that the magnet attracts the non-magnetized material. The non-magnetized material may be a ferromagnetic material such as iron.

Figure 9:
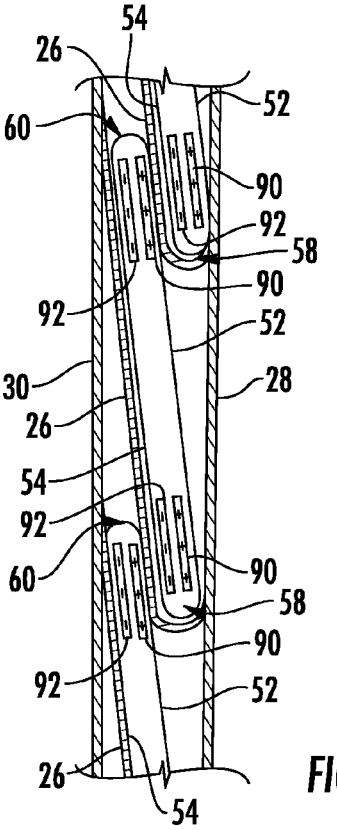
FIG. 9 is a side view of yet another embodiment of the invention.

An alternate embodiment of the window covering is shown in FIG. 9. In this embodiment each longitudinal edge 58 and 60 of the slat 50 is provided with a magnetic field of a first polarity on one of surfaces 52 and 54 and a second polarity on the opposite of surfaces 52 and 54. In the FIG. 9 embodiment the upper surface 52 of each slat is formed with a magnetic field 90 of a first polarity (e.g. positive) along each longitudinal edge thereof and the lower surface 54 of each slat is formed with a magnetic field 92 of an opposite polarity (e.g. negative) along each longitudinal edge thereof. In the closed position the opposing magnetic fields attract one another to create the closing force F as previously described. The poles of the magnets are also arranged to be attracted to one another when the blind is in the fully raised position to eliminate the possibility of the magnets repelling each other when the blind is in a raised position which may be possible in the embodiment of FIG. 5. In the embodiment of FIG. 9 the bottom rail 19 must be heavy enough to break the magnetic attractive force between the slats when subject to gravity when the blinds are lowered from the raised position.

The use of magnets provides a visual and auditory signal to the user that the blind is in the fully closed and sealed position. Because the slats are forced into engagement with one another little or no light will leak through the gaps between the slats providing a visual indication to the user that the blind is fully closed. Further, the magnets cause the slats to close together with an audible click to provide an auditory signal that the blind is fully closed.

Figure 10:
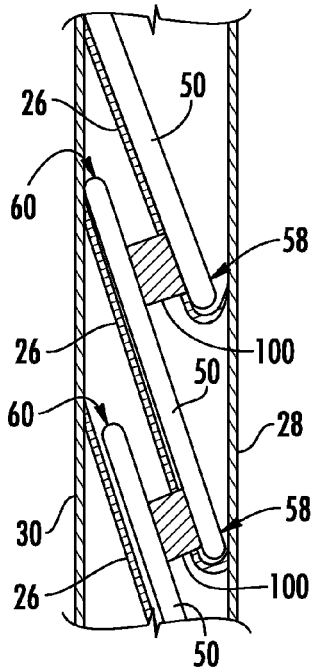
FIG. 10 is a side view showing still another embodiment of the invention.
Figure 11:
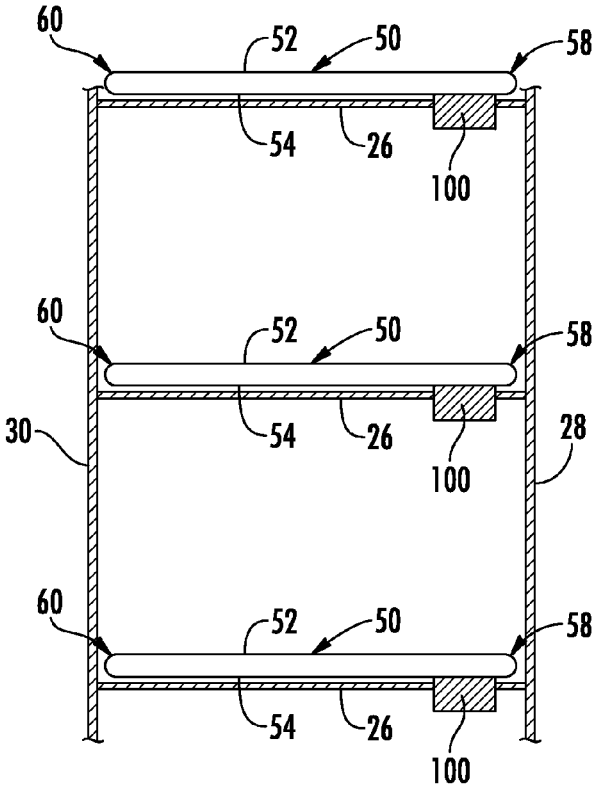
FIG. 11 is a side view of the embodiment of the blind of FIG. 10 in an open position.
Figure 12:
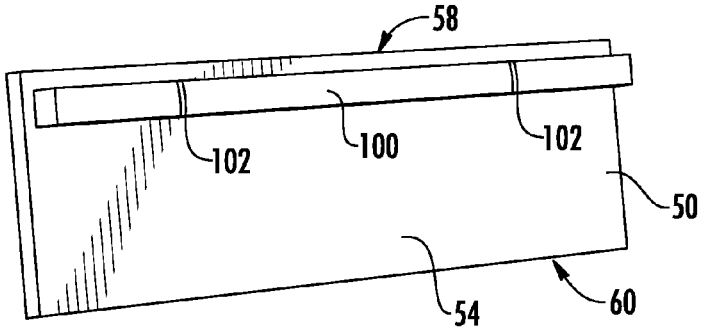
FIG. 12 is a perspective view of an embodiment of the slat used in the embodiment of FIG. 10.

Another embodiment for forming a sealed slat is shown in FIGS. 10 through 12 where a seal or gasket 100 is secured to the slat 50 that compensates for any gaps that may exist between the adjacent slats when the slats are closed. The slat 50 may be made of a first material and the seal 100 may be made of a second material. The first material comprises a relatively rigid material such as wood, PVC, metal or the like and the second material comprises a relatively deformable elastic material such as an elastomeric polymer such as rubber, thermoplastic elastomer or the like. The seal 100 may be formed on the top surface 52 or the bottom surface 54 of the slats and is positioned such that the seal is disposed between the slats in the area where the slats would abut if the slats were fully closed. In the illustrated embodiment the seal is formed on bottom surface 54 adjacent the front longitudinal edge 58. The seal 100 may also be formed on top surface 52 adjacent the rear longitudinal edge 60. The seal 100 may be made of a deformable elastic material such as an elastomeric polymer, rubber or the like. In one embodiment the seal 100 is coextruded with the slat 50. The slat 50 may be extruded of a rigid plastic such as PVC and the seal may be co-extruded of a relatively softer, elastic material such as an elastomeric polymer. The seal may also be made separate from the slat and attached to the slat by any suitable mechanism such as adhesive, welding, mechanical fasteners or the like.

When the slats are rotated to the closed position the seal 100 fills the gaps between adjacent slats to create a seal between adjacent slats as shown in FIG. 10. Because the seal 100 is deformable, the seal may be compressed by the slats in areas where the slats abut or almost abut but remain expanded in areas where the slats do not completely close. The seal 100 may be dimensioned to fill the largest gap between the adjacent slats for a given shade panel. Slots 102 may be formed in the seal to receive the rungs 26 of the ladder cord. Because the seal 100 is deformable the slots 102 may be eliminated and the rungs may simply compress the seal 100. While FIGS. 10 through 12 show a seal 100 along one longitudinal edge of slat 50 the seal may be provided along both longitudinal edges of the slat if desired.

Figure 13:
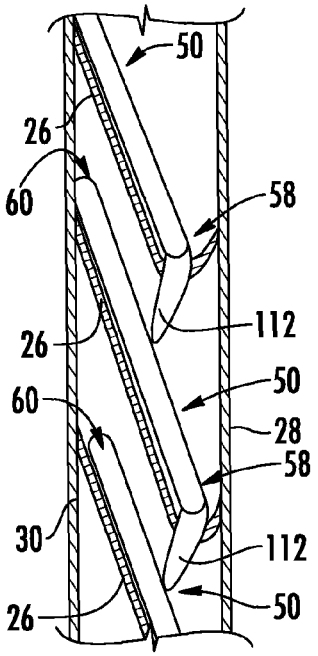
FIG. 13 is a side view showing yet another embodiment of the invention.
Figure 14:
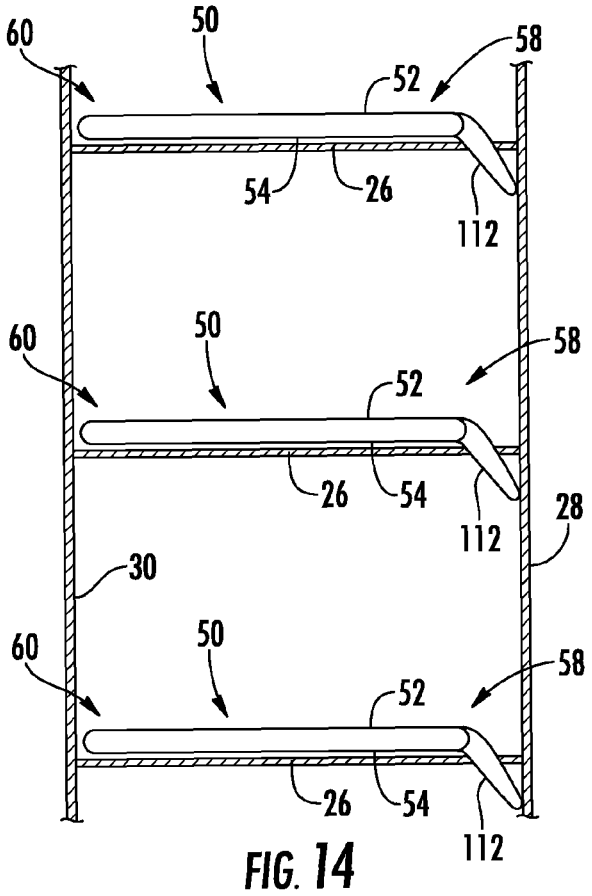
FIG. 14 is a side view of the embodiment of the blind of FIG. 13 in an open position.
Figure 15:
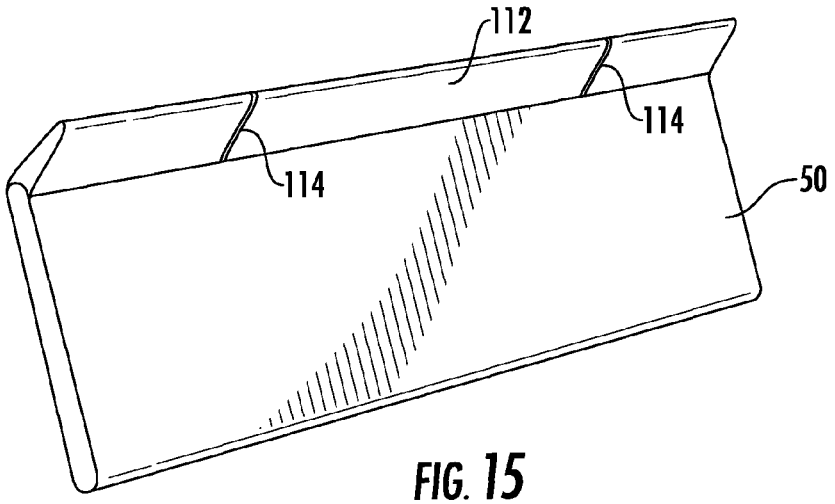
FIG. 15 is a perspective view of an embodiment of the slat used in the embodiment of FIG. 13.

Referring to FIGS. 13 through 15, another embodiment of a slat is shown comprising a slat 50 made of a first material and a seal or gasket 112 made of a second material. The first material comprises a relatively rigid material such as wood, PVC, metal or the like and the second material comprises an elastic deformable material such as an elastomeric polymer such as rubber, thermoplastic elastomer or the like. In one embodiment the slat 50 and seal 112 may be coextruded where the slat is extruded of a rigid plastic such as PVC and the seal is co-extruded of a relatively more pliable material such as an elastomeric polymer. The seal 112 may also be made separate from the slat 50 and attached to the slat by any suitable mechanism such as adhesive, welding, mechanical fasteners or the like. The slat 50 is made of a rigid material to provide rigidity to maintain the shape of the slat and support the slat during use. The seal 112 uses an elastic material that fills in the gaps between the slats and that may be compressed between the slats when the slats are closed. In one embodiment the slat 50 and seal 112 may be made of the same material such as PVC where the slat has a first thickness of approximately 2.0 mm or greater and the seal is formed as a thin section of approximately 0.5 mm or less.

In the embodiment of FIGS. 13 through 15 the seal 112 is formed along one longitudinal edge of the slat and extends from the slat in a cantilevered fashion such that one longitudinal edge of the slat is formed by the seal. In the illustrated embodiment the seal 112 is formed along the front longitudinal edge 58. The seal 112 is shaped and positioned such that it extends toward the adjacent lower slat beyond the plane of the lower surface 54 of the slat 50. The seal may also be formed on the rear longitudinal edge 60 and be shaped and positioned such that it extends toward the adjacent higher slat beyond the plane of the upper surface 52 of the slat 50. When the slats 50 are moved to the closed position, the seals 112 fill the gaps between adjacent slats. Because the seal 112 is made of a relatively soft elastic material, the seal may be deformed by the slats 50 to accommodate variations in the size of the gaps between the slats as shown in FIG. 13. Slots 114 may be formed in the seal 112 to receive the rungs 26 of the ladder cord. Because the seal 112 is deformable, the slots 114 may be eliminated and the rungs 26 may simply compress the seal 112. While FIGS. 13 through 15 shows a seal along one longitudinal edge of slat 50 a seal may be formed along each longitudinal edge of the slat if desired.

Figure 16:
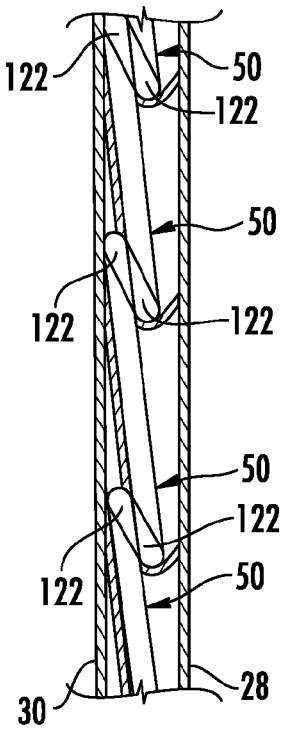
FIG. 16 is a side view showing yet another embodiment of the invention.

Referring to FIG. 16 an alternate embodiment of the slat is shown comprising a slat 50 made of a first material and a seal or gasket 122 made of a second material. The first material is made of a relatively rigid material such as wood, PVC or the like and the second material comprises a relatively deformable elastic material such as an elastomeric polymer such as rubber, thermoplastic elastomer or the like. In one embodiment the slat 50 and seal 122 are coextruded where the slat is extruded of a rigid plastic such as PVC and the seal is co-extruded of a relatively more elastic material such as an elastomeric polymer. The seal may also be made separate from the slat and attached to the slat by any suitable mechanism such as adhesive, welding, mechanical fasteners or the like. The slat 50 uses a rigid material to provide rigidity to maintain the shape of the slat and support the slat during use. The seal uses a softer elastic material that fills in the gaps between the slats and that may be compressed between the slats when the slats are closed. The seal 122 in the embodiment of FIG. 16 is arranged such the seal 122 is formed as an insert in the slat 50 where the seal does not extend beyond the plane of the slat. The seal 122 is formed on the bottom surface 54 of the front longitudinal edge 58 and on the top surface 52 of the rear longitudinal edge 60 such that when the slats are closed the seals of one slat are opposed to and abut the seals of the adjacent slats. Because the seals are formed of an elastic material the seals may compress against one another to accommodate variations in the planarity and alignment of the slats.

Figure 17:
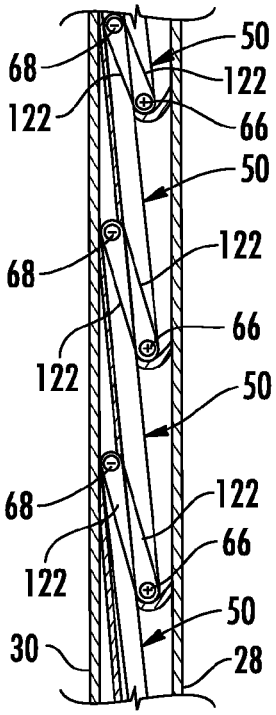
FIG. 17 is a side view showing still another embodiment of the invention.

Another embodiment of the slat is shown in FIG. 17 and combines the magnetic structures and seal structures as previously described. The slats 50 may be made of a relatively rigid material such as wood, PVC, metal or the like and the seals 122 may be made of a relatively deformable material such as an elastomeric polymer such as rubber, thermoplastic elastomer or the like as previously described. A magnetic field of opposite polarity is formed along each longitudinal edge 58, 60 of the slat 50. For example, one longitudinal edge 60 of each slat 50 is provided with a positive polarity magnetic field 66 and the other longitudinal edge 58 of each slat 50 is provided with a negative polarity magnetic field 68. Each slat 50 has the same longitudinal edge provided with the same polarity magnetic field such that when the slats are tilted to the closed position, shown in FIG. 17, the opposing polarity magnetic fields 66, 68 attract one another to apply a closing force on the slats that pulls the longitudinal front edge of one slat into engagement with longitudinal rear edge of the adjacent slats to the sealed position of FIG. 17. In the sealed position the elastic seal 122 on one longitudinal edge of one slat is in abutting contact with the elastic seal 122 on the opposite longitudinal edge of the adjacent slat. The seals may compress against one another and/or against the rigid slat to accommodate variations in the planarity and alignment of the slats. The sealing force generated by the magnetic field is selected to provide enough force to seal the slats against one another while minimizing the opening force required when separating the slats during opening of the window covering. The seals may comprise any of the embodiments described herein combined with any of the magnetic arrangement described herein.

The magnetic force may be created by magnets positioned in the slat 50 or in the seal 122 such that the magnets are not visible during normal use of the window covering. In a polymer seal or slat the magnet may be co-extruded or cross-head die extruded into the polymer slat or in the polymer seal. In such an embodiment the magnet may be completely embedded in the polymer material. The ferric material of the magnet may be magnetized before or after the ferric material is embedded in the polymer material, as previously described. The magnet may also be applied to a pre-formed slat such as by using adhesive or a mechanical connector. The magnet may comprise a strip or tape magnet and/or a plurality of separate magnets spaced along the longitudinal edge of the slat 50 as previously described. To improve the slat's appearance, the magnets may be located in slots formed in the seal or slat to maintain the outward appearance of the slat, as previously described. The magnets and slots may be covered by caps to further conceal the magnets as previously described.

Another embodiment of a sealing structure is shown in FIGS. 18 through 21 where a magnetic strip 140 of a first polarity is attached to the bottom surface 54 of each of slats 50. The magnetic strip 140 is attached such that the strip extends beyond the rear longitudinal edge 60 of the slat 50 for substantially the entire length of the slat. The arrangement of the strip 140 and slat 50 create a pocket 142 for receiving the adjacent slat. When the slats are closed the front longitudinal edge 58 of one slat fits into the pocket 142 of the adjacent slat with the bottom surface 54 of the one slat abutting the magnetic strip 140. The bottom surface 54 of each strip is provided with a magnetic strip 144 of opposite polarity from magnetic strip 140 such that the magnetic fields attract one another to create a sealing force between the adjacent slats. One of the magnetic strips 140 or 144 may be replaced by a ferromagnetic material such as iron.

Figure 22:
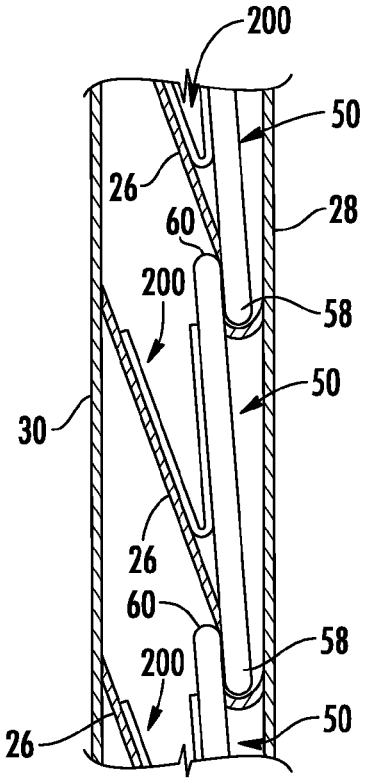
FIG. 22 is a side view of another embodiment of the invention.
Figure 18:
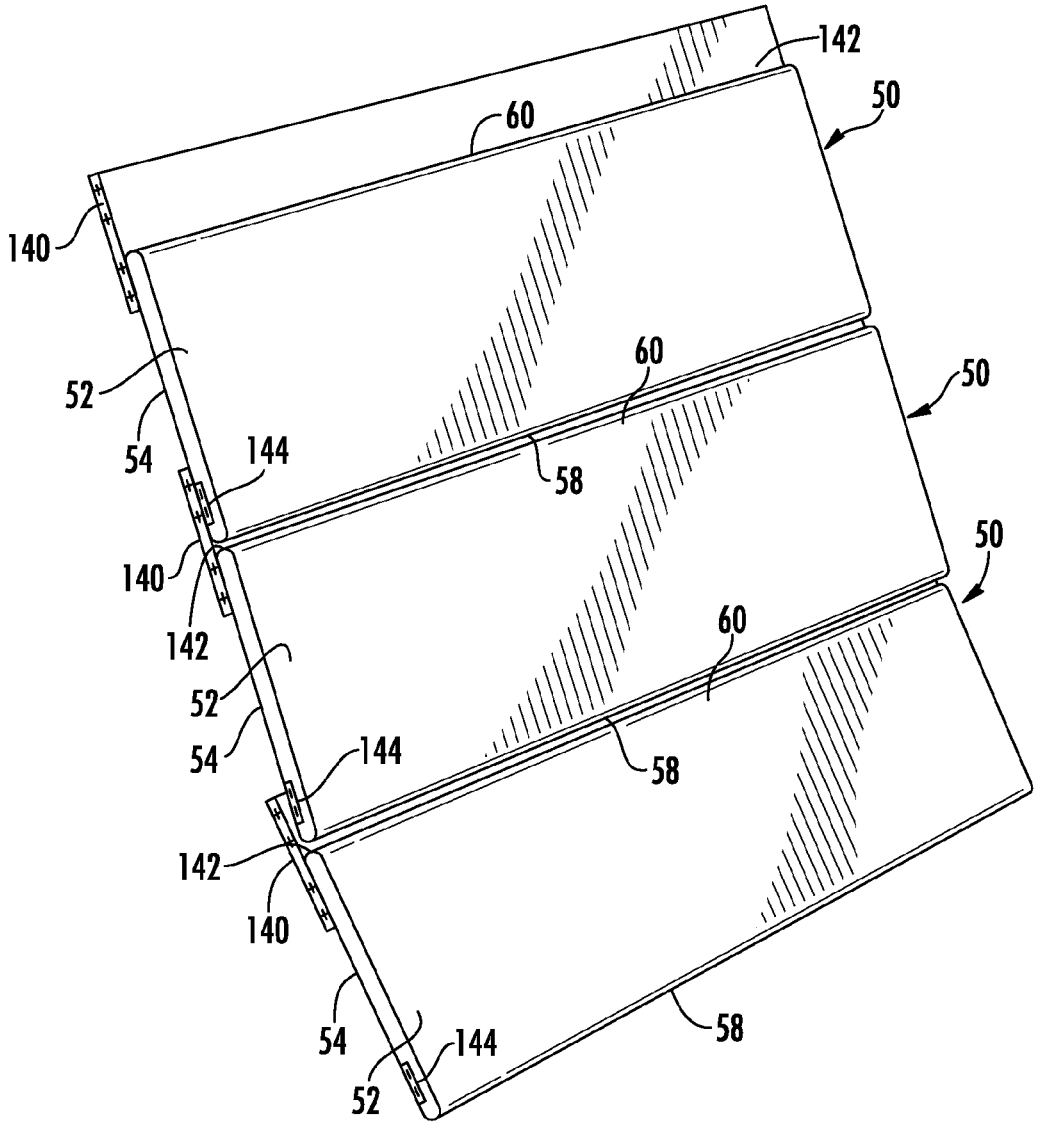
FIG. 18 is a perspective view showing yet another embodiment of the invention.
Figure 19:
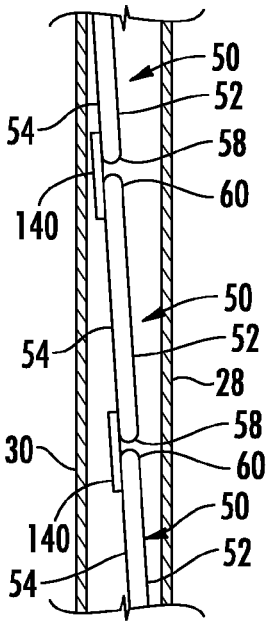
FIG. 19 is a side view of the embodiment of the blind of FIG. 18 in a closed position.
Figure 20:
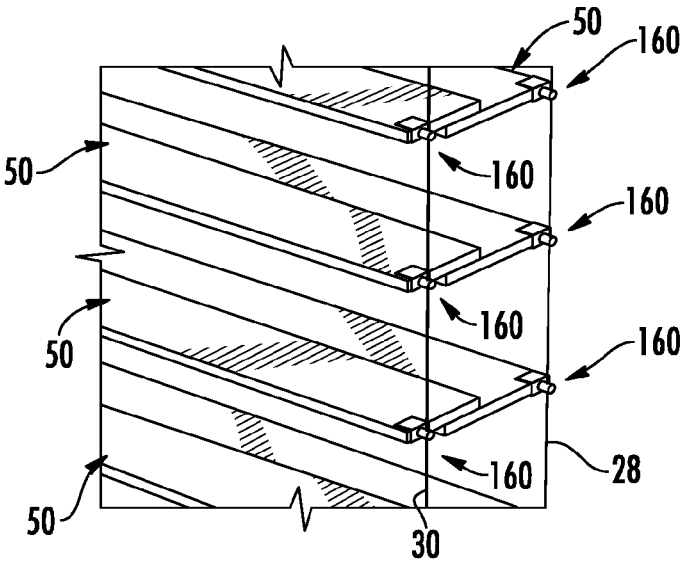
FIG. 20 is a perspective view of an embodiment of the slat support used in the embodiment of FIG. 18.
Figure 21:
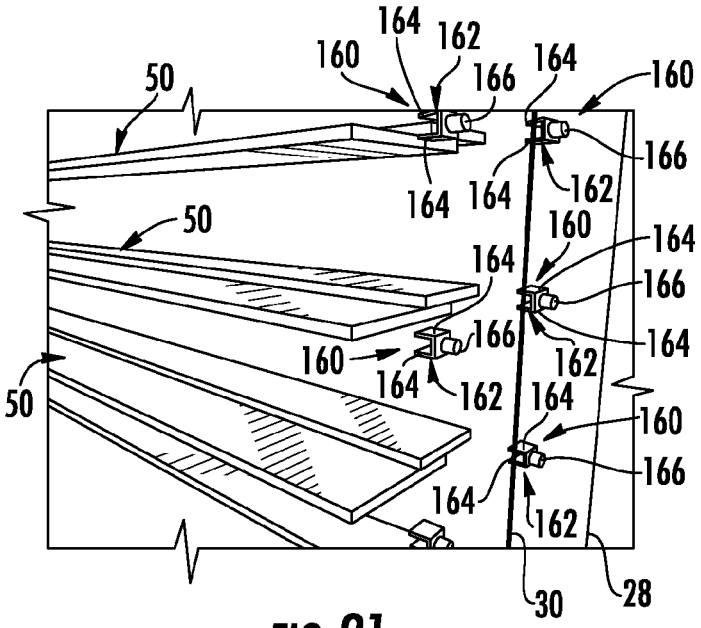
FIG. 21 is an exploded perspective view of the slat support of FIG. 20.

Because the longitudinal edge 58 of each slat must fit into the pocket 142 of the adjacent slat, in some embodiments it may be desirable to use guide clips 160 to attach the slats 50 directly to the tilt cords 28 and 30, as shown in FIGS. 21 and 22, rather than simply resting the slats on the rungs 26 of a ladder-type tilt cord. The guide clips 160 provide a mounting structure to secure the slats 50 in a fixed position on the vertical tilt cords 28 and 30. In one embodiment the guide clips 160 comprise a slat attachment mechanism 162 such as the illustrated U-shaped member that fits over the ends of the slat and tightly engages the slat between the arms 164. The guide clips 160 may be removed from the slat for cleaning, maintenance or the like. The clips 160 may also be secured to the slats by adhesive, a mechanical fastener, or other permanent or releasable slat attachment mechanism. The slat attachment mechanism 162 rotatably supports a cord guide 166. The cord guide 166 engages and is fixed to the tilt cords 28 and 30 to fix the position of the slats 50 relative to the cords. As the tilt cords 28 and 30 move up and down to tilt the slats, the rotating cord guides 166 accommodate the rotational movement of the slats. When the slats 50 are rotated to a closed position by raising one tilt cord 28 and lowering the other tilt cord 30, the guide clips 160 ensure that the longitudinal edges 58 and 60 of the slats remain in aligned positions relative to one another. As a result, when the slats reach the closed or nearly closed position the rear longitudinal edge 60 of one slat is aligned with the front longitudinal edge 58 of the adjacent slat such that when the magnetic field pulls the slats to the sealed position the front longitudinal edge 58 of one slat is properly positioned in the pocket 142 of the adjacent slat.

Another embodiment of the invention is shown in FIG. 22. A spring 200 is positioned between the rungs 26 of the ladder cord and the bottom surfaces 54 of the slats 50. The spring 200 creates a biasing force tending to move the slat 50 away from the rung 26. As the slats 50 are closed, the rear longitudinal edge 60 of one slat abuts the front longitudinal edge 58 of the adjacent slat to compress the spring 200 and create a force on the slat tending to bias the slats to the sealed position. The force generated by the springs 200 on the slats 50 helps to overcome the warp that is inherent in some slats such as extruded slats. The spring strength is selected such that in the open position (i.e. when the slat is approximately horizontal) the weight of the slat compresses the spring such that the slat rests on, or nearly rests on, the tilt cords while in the substantially vertical closed position the spring biases the slat against the adjacent slat.

Figure 23:
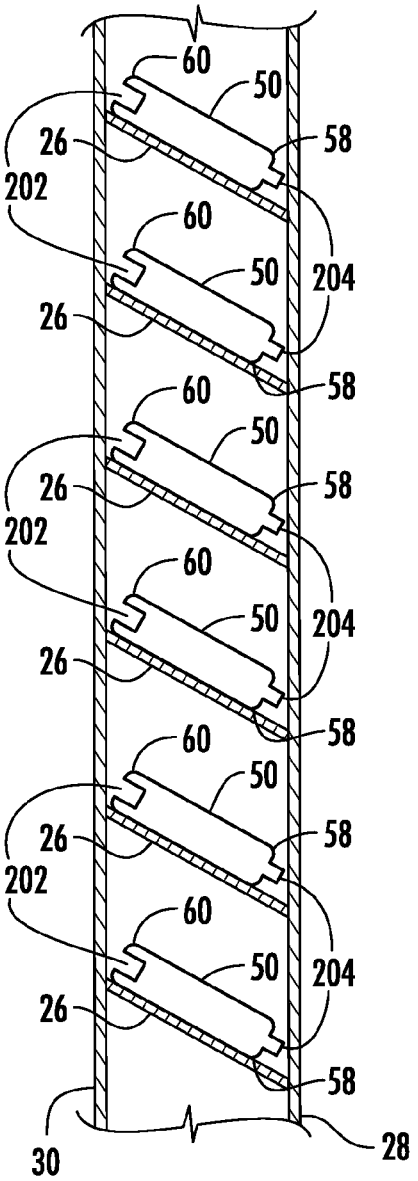
FIG. 23 is a side view of yet another embodiment of the invention in an open position.
Figure 24:
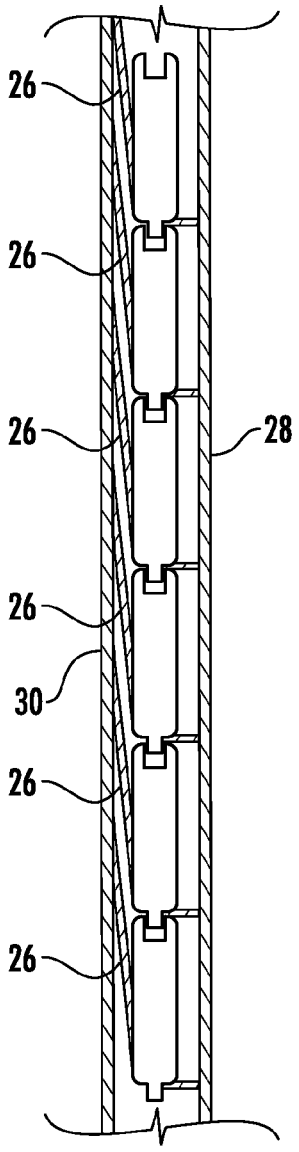
FIG. 24 is a side view of the embodiment of FIG. 23 in a closed position.

Another embodiment of a sealed slatted blind is shown in FIGS. 23 and 24. This embodiment uses a tongue and groove joint between adjacent slats to create an overlapping relationship between the longitudinal edges of the slats. A first longitudinal edge 60 of the slat 50 is provided with a groove 202 that extends along substantially the entire length of the slat. A second longitudinal edge 58 of the slat is provided with a tongue 204 that extends along substantially the entire length of the slat. The tongue 204 and groove 202 are dimensioned such that the tongue 202 of one slat may be located in the groove 202 of the adjacent slat when the blind is rotated between the open position of FIG. 23 and the closed position of FIG. 24. In order to insert the tongues 202 into the grooves 204 it is necessary to lift the upper slat relative to the lower slat (or lower the lower slat relative to the upper slat) and insert the tongue 204 of one slat into the groove 202 of the adjacent slat. A cam may be provided in the head rail to lift and then lower bottom edges of the slats. Alternatively, camming mechanisms may likewise be provided along the ladder rungs for every slat or for every other slat which causes the corresponding slat or slats to raise (or lower) during the closing/opening actuation of the ladder cord. In other embodiments, the ends of each slat or every other slat may include tilting means that are operable to cause a slight raising (or lowering) movement during the opening/closing actuation of a corresponding control mechanism. In yet another embodiment, a grooved edge may comprise at least on elastomeric or other flexible or deformable member forming at least one edge of the groove (similar to the various embodiments described herein, such as shown in, and described with reference to, FIGS. 10-15), such that during opening and closing of the slat, the tongue 202 of the adjacent slat deforms one edge of the groove to release from the slot or pass into eh slot.

Specific embodiments of an invention are disclosed herein. One of ordinary skill in the art will recognize that the invention has other applications in other environments. Many embodiments are possible. The following claims are in no way intended to limit the scope of the invention to the specific embodiments described above.

The invention claimed is:

1. A window covering comprising:

a first slat and a second slat suspended from a tilt cord such that the tilt cord may rotate the first slat and the second slat between an open position and a closed position, a first magnetic field of a first polarity formed along a first longitudinal edge of the first slat and a second magnetic field of a second polarity formed along a second longitudinal edge of the second slat such that in the closed position the first longitudinal edge is disposed adjacent the second longitudinal edge;

a first elastic seal formed along a first longitudinal edge of the first slat and a second elastic seal formed along a second longitudinal edge of the second slat, the first seal positioned to contact the second seal when the first slat and the second slat are in the closed position such that the first magnetic field and the second magnetic field pull the first seal and the second seal into engagement with one another such that the first seal and the second seal are compressed against one another.

2. The window covering of claim 1 wherein the first seal and the second seal are made of an elastomeric polymer.

3. The window covering of claim 1 wherein the first slat is extruded of a rigid plastic and the first seal is co-extruded with the first slat and comprises an elastic material that is relatively more elastic than the rigid plastic.

4. The window covering of claim 1 wherein a thermally insulating film is applied over at least a portion of a surface of the first slat and at least a portion of a surface of the second slat.

5. The window covering of claim 1 wherein a ferromagnetic material is formed along the second longitudinal edge of the second slat.

6. The window covering of claim 1 wherein the first magnetic field is created by a first magnet having the first polarity supported along the first longitudinal edge of the first slat, and the second magnetic field is created by a second magnet having the second polarity supported along the second longitudinal edge of the second slat and in the closed position the first magnet is disposed adjacent the second magnet.

7. The window covering of claim 6 wherein the first magnet is extruded in the first slat.

8. The window covering of claim 6 wherein the first magnet is a tape magnet.

9. The window covering of claim 1 wherein a third magnetic field of the first polarity and a fourth magnetic field of the second polarity are formed along a third longitudinal edge of the first slat, and a fifth magnetic field of the first polarity and a sixth magnetic field of the second plurality are formed along a fourth longitudinal edge of the second slat.

10. The window covering of claim 9 wherein the first magnetic field and the third magnetic field are formed on a first surface of the first slat and the second magnetic field and the fourth magnetic field are formed on a second surface of the first slat and the fifth magnetic field is formed on a first surface of the second slat and the sixth magnetic field is are formed on a second surface of the second slat.

* * * * *